US007946892B2

(12) United States Patent
Carboni et al.

(10) Patent No.: US 7,946,892 B2
(45) Date of Patent: May 24, 2011

(54) CONNECTION DEVICE FOR ELECTRICAL OR ELECTRONIC CONNECTIONS

(75) Inventors: Vittorio Carboni, Genova (IT); Paolo Manzi, Genova (IT)

(73) Assignee: Hypertac S.p.A., Genova (IT)

( * ) Notice: Subject to any disclaimer, the term of this patent is extended or adjusted under 35 U.S.C. 154(b) by 267 days.

(21) Appl. No.: 12/299,551

(22) PCT Filed: Apr. 30, 2007

(86) PCT No.: PCT/EP2007/054210

§ 371 (c)(1),
(2), (4) Date: Nov. 4, 2008

(87) PCT Pub. No.: WO2007/128728

PCT Pub. Date: Nov. 15, 2007

(65) Prior Publication Data

US 2009/0137158 A1 May 28, 2009

(30) Foreign Application Priority Data

May 5, 2006 (IT) ..... 2006A0051

(51) Int. Cl.
*H01R 24/00* (2006.01)

(52) U.S. Cl. ..... 439/660

(58) Field of Classification Search ..... 439/660, 439/608, 578–585, 824, 680

See application file for complete search history.

(56) References Cited

U.S. PATENT DOCUMENTS

| | | | | |
|---|---|---|---|---|
| 2,858,518 | A * | 10/1958 | Chrystie et al. | 439/426 |
| 4,516,821 | A * | 5/1985 | Nieman | 439/347 |
| 7,040,909 | B2 * | 5/2006 | Cairns | 439/271 |
| 7,695,302 | B2 * | 4/2010 | Eissner et al. | 439/352 |
| 2008/0207040 | A1 | 8/2008 | Eissner et al. | |

FOREIGN PATENT DOCUMENTS

EP 1 237 230 9/2002

* cited by examiner

*Primary Examiner* — Edwin A. Leon
(74) *Attorney, Agent, or Firm* — Stites & Harbison PLLC; Marvin Petry

(57) ABSTRACT

Connection device for electrical or electronic connections. A socket connector with a plurality of contact sockets and a pin connector with a plurality of pin contacts is connected to an electric cable following insertion of the pin connector inside this socket connector. The pin connector has an internally hollow main body which houses a bush inside which these contacts are inserted. The socket connector has an internally hollow main body which houses a second bush and inside which these contact sockets are inserted. The main body of the pin connector is provided with a free section able to engage sealingly inside an annular cavity of this socket connector. A toroidal spring engages grooves in both the socket connector and pin connector to form a snap-type connection therebetween.

20 Claims, 5 Drawing Sheets

CONNECTION DEVICE FOR ELECTRICAL OR ELECTRONIC CONNECTIONS

This application is a 371 of PCT/EP2007/054210 filed Apr. 30, 2007.

The present invention relates to a connection device for electrical or electronic connections.

BACKGROUND OF THE INVENTION

As is known the normal connection devices for electrical or electronic connections are provided with a socket connector connected, for example, to the wall of a panel or a container and a pin connector having, on the one hand, pins able to engage inside suitable sockets of the socket connector and, in the other hand, connections for a normal electric cable. The pin connector must be made with a form which matches exactly the socket connector so that, when this pin connector is inserted inside the socket connector, an efficient electrical or electronic connection is guaranteed and moreover a certain sealing action preventing the entry of external agents, such as dust or the like, is ensured. These connectors generally have a cylindrical, rectangular or square shape and the electric cable, with respect to the pin connector, may be in alignment with the contact pins or arranged perpendicularly with respect thereto. In the pin connector contacts formed by a pin provided with an axial stem around which a resilient-tensioning helical spring is wound may be used. This spring is arranged between said pin and a scored hyperboloid, which is connected to a connection terminal, and able to ensure contact with the external surface of said stem.

These known connectors have various drawbacks including, in the case where these contacts provided with a scored hyperboloid are used, the difficulty of alignment between the hyperboloid and the stem of the pin. Moreover, since the pin connector, whether it be cylindrical or rectangular, is inserted inside the socket connector in order to perform the connection of the pins with the associated sockets, often problems relating to the sealing action may arise, with the possibility of entry of dust or other external agents which adversely affect the reliability and the wear of these connectors.

SUMMARY OF THE INVENTION

The object of the present invention, therefore, is to provide a connection device for electrical or electronic connections which overcomes the drawbacks of the known devices mentioned above.

This object is achieved by the present invention by means of a connection device for electrical or electronic connections, comprising a socket connector with a plurality of contact sockets and a pin connector connected to an electric cable and having a plurality of contacts provided with pins able to engage with these contact sockets following insertion of this pin connector inside this socket connector, characterized in that this pin connector comprises an internally hollow main body which houses, inside it, at least one first bush which is made of insulating material and inside which these contacts are inserted and from which these pins protrude, and this socket connector comprises an internally hollow main body which houses, inside it, a second bush which is made of insulating material and inside which these contact sockets are inserted; this main body of the pin connector is provided with a free section able to engage sealingly inside an annular cavity formed between this second bush made of insulating material and the inner walls of the main body of this socket connector.

BRIEF DESCRIPTION OF THE DRAWINGS

Further advantages and characteristic features of the device according to the present invention will become clear from the following detailed description of certain embodiments thereof, provided by way of a non-limiting example, with reference to the accompanying plates of drawings, in which.

DETAILED DESCRIPTION OF THE PREFERRED EMBODIMENTS

Figure 1:
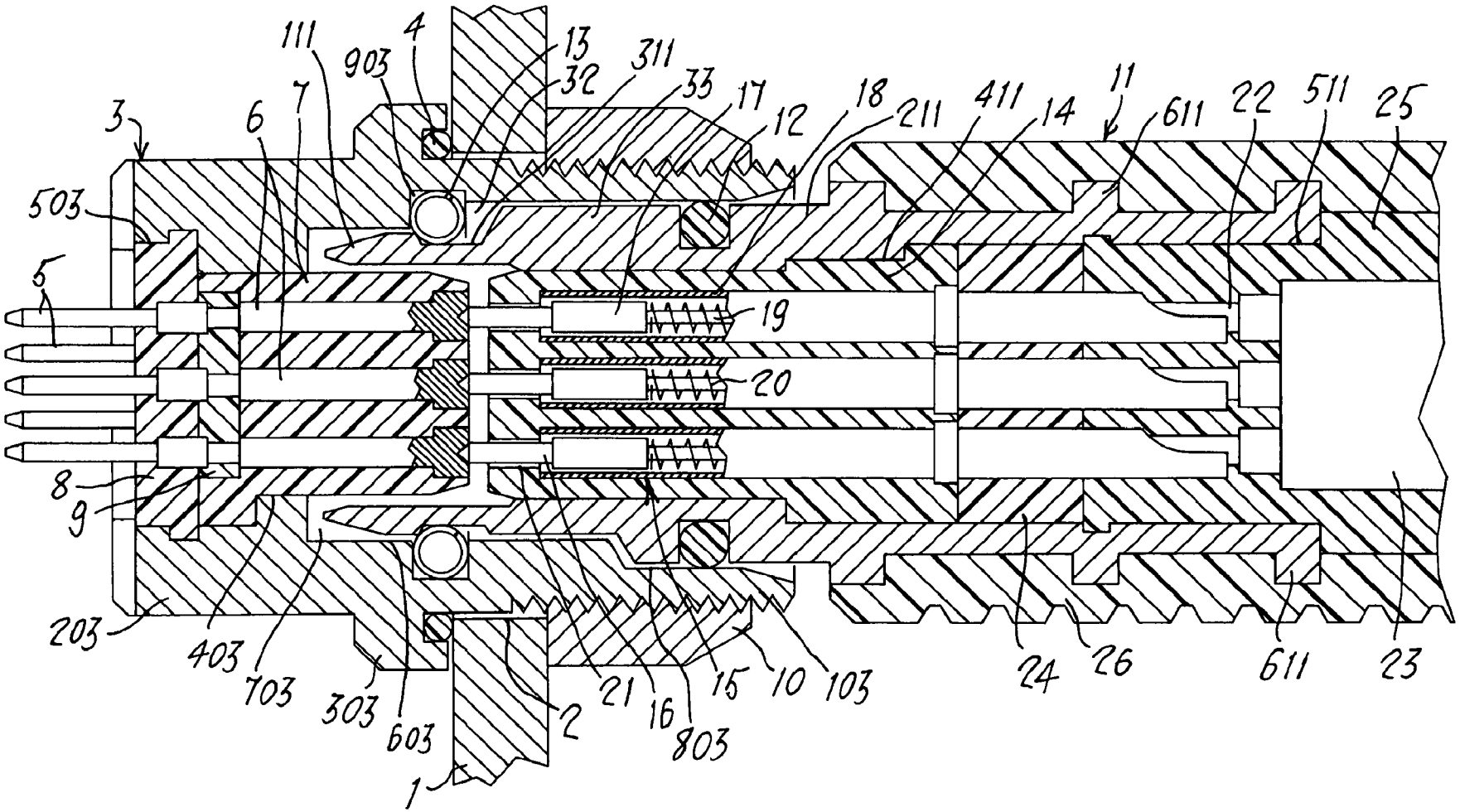
FIG. 1 shows a cross-sectional view of a first embodiment of a connector device for electrical or electronic connections according to the present invention, comprising a first socket connector fixed to a panel and a second pin connector connected to an electric cable.

With reference to these accompanying drawings and with particular reference to FIG. 1 thereof, 1 denotes a panel in which a hole 2 for receiving a socket connector 3 is formed, said connector comprising a main body 203 which is preferably made of metallic material and has, on one side, a threaded cylindrical section 103, projecting outwards from said panel 1, and a flange 303 for resting against the inner wall of said panel 1. A sealing ring 4 is provided between this flange 303 and the wall of the panel 11 close to the through-hole 2. On the opposite side to said threaded cylindrical section 103, this main body 203 comprises a cylindrical opening 503 from which a series of electronic contact terminals 5, for example for printed circuit boards (PCB), emerge. These terminals 5 are connected to associated contact sockets 6 embedded in a bush 7 made of insulating thermoplastic material. This bush 7 is inserted inside a first cylindrical seat 403 formed inside the main body 203 of the socket connector. A sealing plug 8, for example made of epoxy resin, and a sealing base piece 9 made of elastomer material, such as rubber or the like, are provided between these contact sockets 6 and these terminals. In particular, the plug 8 is arranged inside said cylindrical opening 503 with a T-shaped cross-section, while the base piece 9 is positioned between said bush 7 and said plug 8 inside a seat formed on one side of this bush 7. This bush 7, this plug and this base piece 9 ensure an optimum seal of the socket connector 3, preventing the entry, on the side of the terminals 5, of atmospheric or polluting agents such as dust or the like. The socket connector 3 is fixed to the wall of the panel 1 by means of a ring 10 which is screwed around the threaded cylindrical section 103 protruding from said panel 1. The main body 203 of said socket connector 3 comprises a second cylindrical seat 603 adjacent and coaxial with said first cylindrical seat 403, but with a greater diameter. The bush 7 with the contact sockets 6 projects inside said second cylindrical seat 603 so as to form between it and the wall of said second cylindrical seat 603 a cylindrical annular cavity 703 inside which the cylindrical end section 111 of the main body 211 of a pin connector 11 is housed. As can be seen, the main body 211—preferably made of metallic material—of the pin connector 11 is inserted inside a substantially cylindrical mouth 803 formed inside the threaded cylindrical section 103 of the socket connector 3, and between the outer wall of this main body 211 of the pin connector 11 and the inner wall of this mouth 803 of the threaded cylindrical section 103 of the socket connector 3 a sealing ring 12 is provided. This substantially cylindrical mouth 803 is formed with a diameter greater than that of said second and first cylindrical seats 603 and 403. A toroidal spring 13 is provided between this second cylindrical seat 603 of the main body 203 of the socket connector 3 and this cylindrical end section 111 of the main body 211 of the pin connector 11, said spring being seated inside a first annular groove 903 formed in said cylindrical seat 603 and able to engage, during insertion of said pin connector 11 inside said socket connector 3, inside a second annular groove 311 formed in the outer wall of said cylindrical end section 111. The main body 211 of the pin connector 11 is internally hollow and comprises a cylindrical seat 411 with various diameters increasing from the inside towards the outside of this pin connector 11. Starting from the inside of the pin connector 11, 14 denotes a first bush which is made of elastomer material, for example neoprene, and is housed inside a first section of this cylindrical seat 411. Contacts 15 as shown and described in U.S. Pat. No. 7,857,671, are embedded in this bush 14. Each of these contacts 15 comprises a pin 16 able enter into contact with the associated contact socket of the socket connector 3 and provided with an end lug 17 inserted inside a tubular container body 18. From the end of the end lug 17 opposite the pin 16 there extends an axial stem 19 which passes through the entire length of the tubular container body 18. A helical spring 20 is wound around this axial stem 19. This pin 16 protrudes from the bush 14 via suitable through-holes 21 formed at the end of said bush 7 directed towards the contact sockets 6. These contacts 15 are connected to electrical wires 22 which are entirely known and protrude from a generic electric cable 23. Proceeding from the inside towards the outside of the main body 211 of the pin connector 11, 24 denotes a second bush which is made of thermoplastic material and is inserted inside an associated section of said cylindrical seat 411 and is adjacent to said first bush 14. The main body 211 of the pin connector 11 comprises at the outer end of the cylindrical seat 411 a mouth 511 inside which a plastic plug 25 containing the electric cable and inserted inside the end section of said cylindrical seat 411 is inserted. This main body 211 comprises externally ribs 611 and has fitted around it, for example, by means of overmoulding, a gripping sleeve 26 made of plastic.

Figure 2:
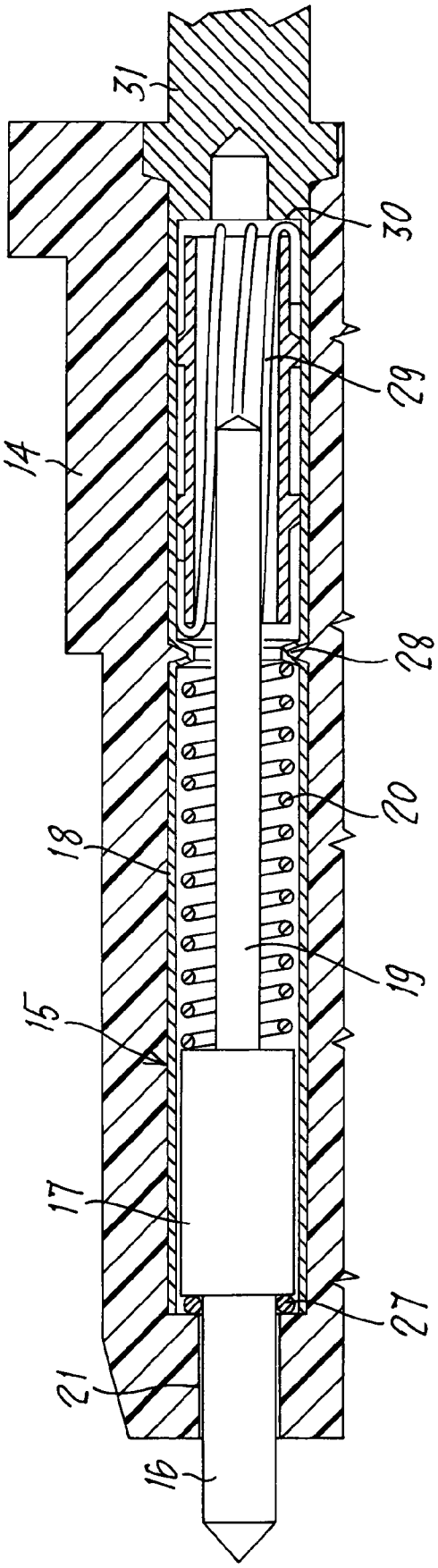
FIG. 2 shows a cross-sectional view of one of the contacts, as shown and described in U.S. Pat. No. 7,857,671, provided in the pin connector of the connection device according to FIG. 1.

FIG. 2 shows one of the contacts 15 embedded inside the bush 14 of the pin connector 11. A seal 27 is inserted between the end lug 17 and the bottom of the tubular container body 18 close to the through-hole 21 formed in the bush 14. The helical spring 20 wound around the axial stem 19 presses on one side against said end lug 17 and on the other side against a constriction 28 formed in said tubular container body 18. The free end of this axial stem 19 passes beyond said constriction 28 and is inserted inside a scored contact hyperboloid 29. This scored hyperboloid 29 therefore presses on one side against the constriction 28 of the tubular container body 18 and on the other side against the base of a blind cavity 30 of a contact terminal 31.

Figure 4:
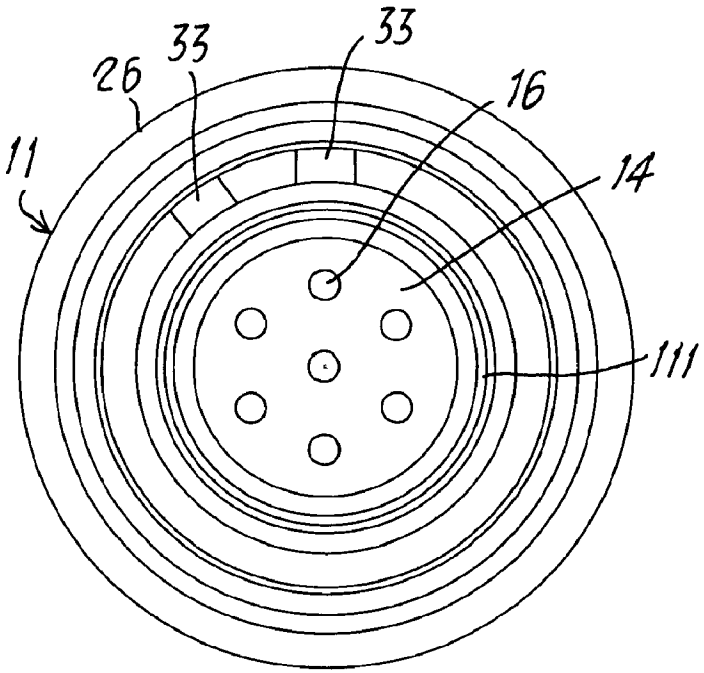
FIG. 4 shows a side view of the pin connector of the connection device according to FIG. 1.
Figure 3:
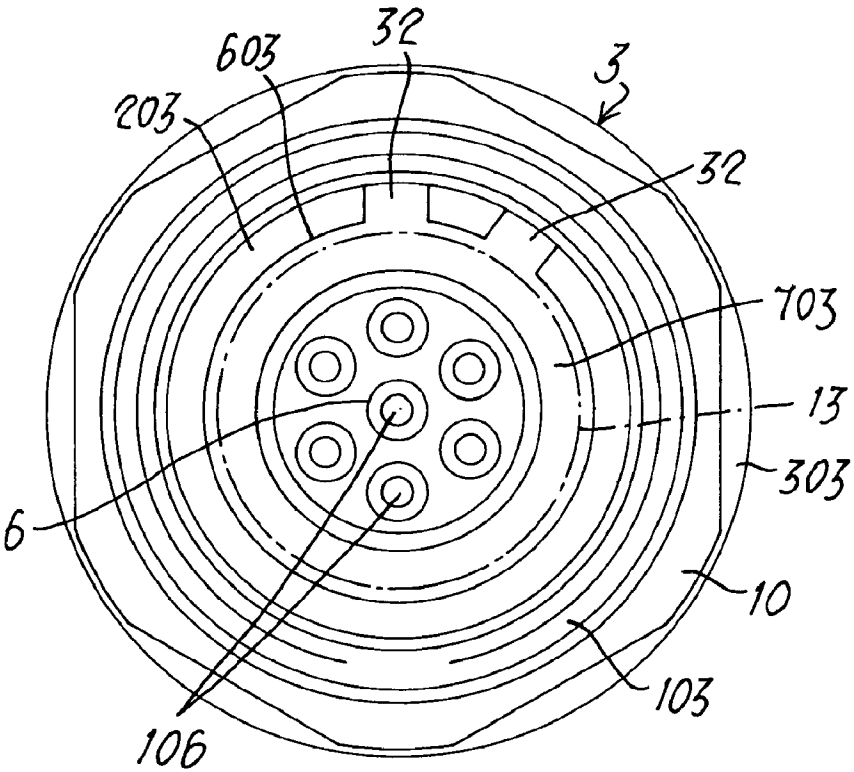
FIG. 3 shows a side view of the socket connector of the connection device according to FIG. 1.

FIG. 3 shows a side view of the socket connector 3 inside which it is possible to see the keying system envisaged for the connection device according to the present invention. The cylindrical seat 603 formed inside the main body 203 of the socket connector 3 is provided internally with two longitudinal grooves 32 able to engage with two corresponding ribs (see FIG. 4) formed on the outside of the cylindrical end section 111 of the main body 211 of the pin connector 11 inserted inside the cylindrical annular cavity 703 formed between the bush 7 and said cylindrical seat 603. These longitudinal grooves 32 engaged by the ribs 33 form the keying system of the present connection device, allowing a single position for insertion of the pin connector 11 inside the socket connector 3. 106 denotes the holes of the contact sockets 6 inside which the pins 16 of the contacts 15 according to FIGS. 1, 2 and 4 are inserted.

Figure 5:
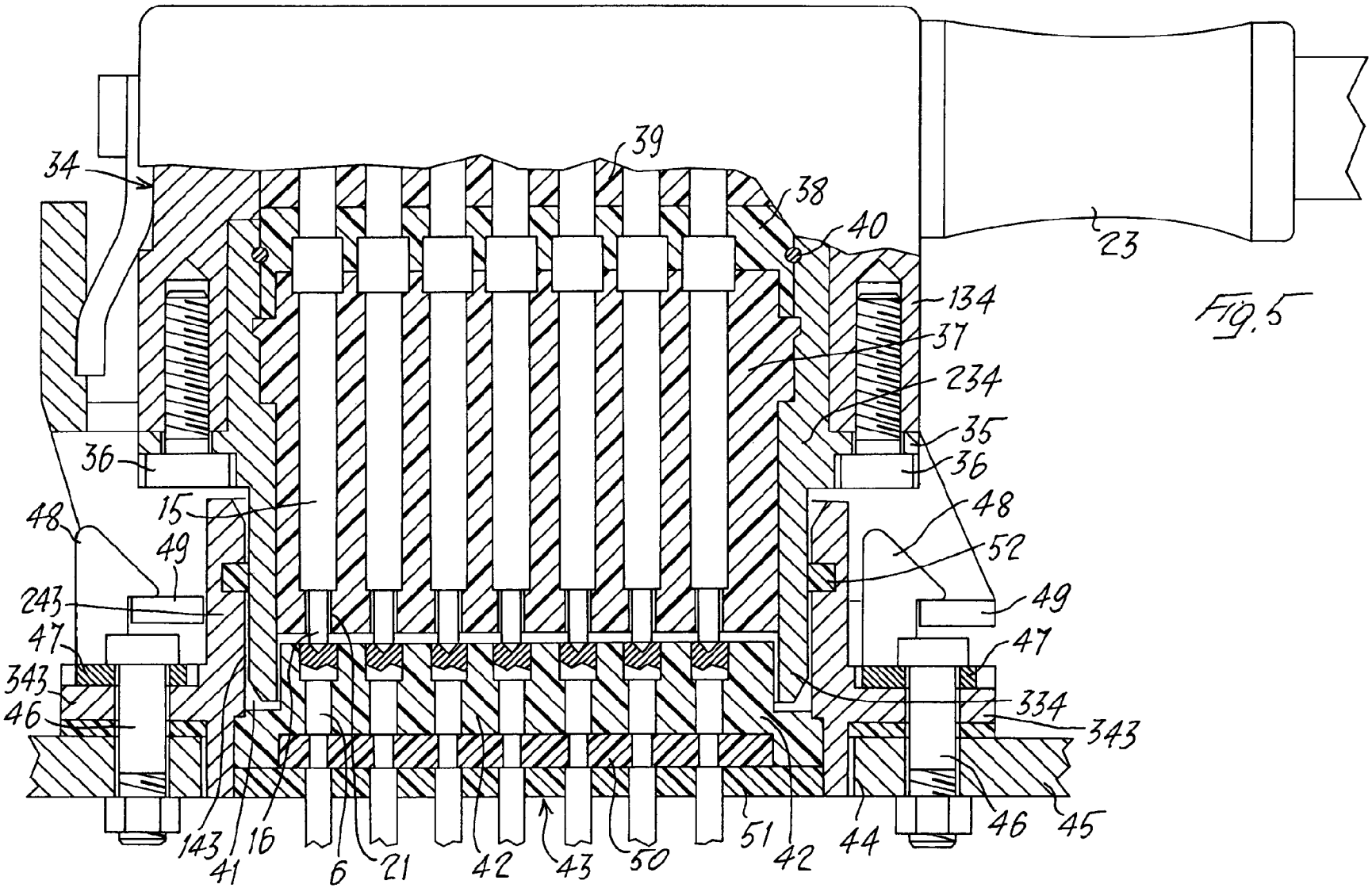
FIG. 5 shows a partially sectioned view of a second embodiment of the connection device according to the present invention, provided with a socket connector fixed to a panel and with a pin connector connected to an electric cable perpendicular to said socket connector.
Figure 7:
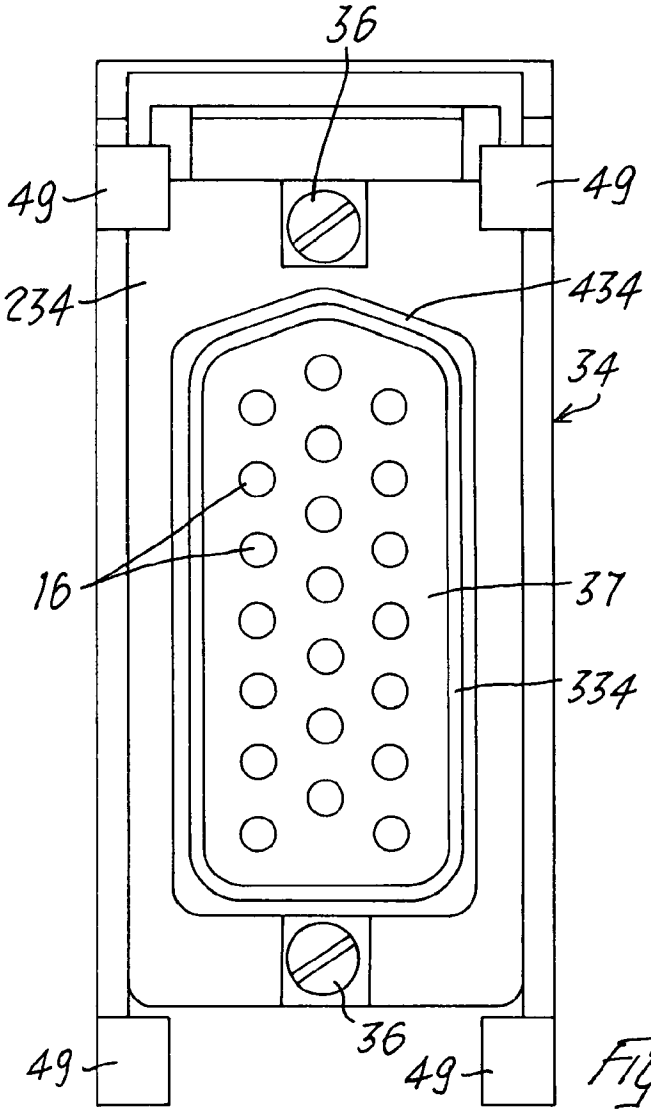
FIG. 7 shows a side view of the pin connector of the connection device according to FIG. 5.
Figure 6:
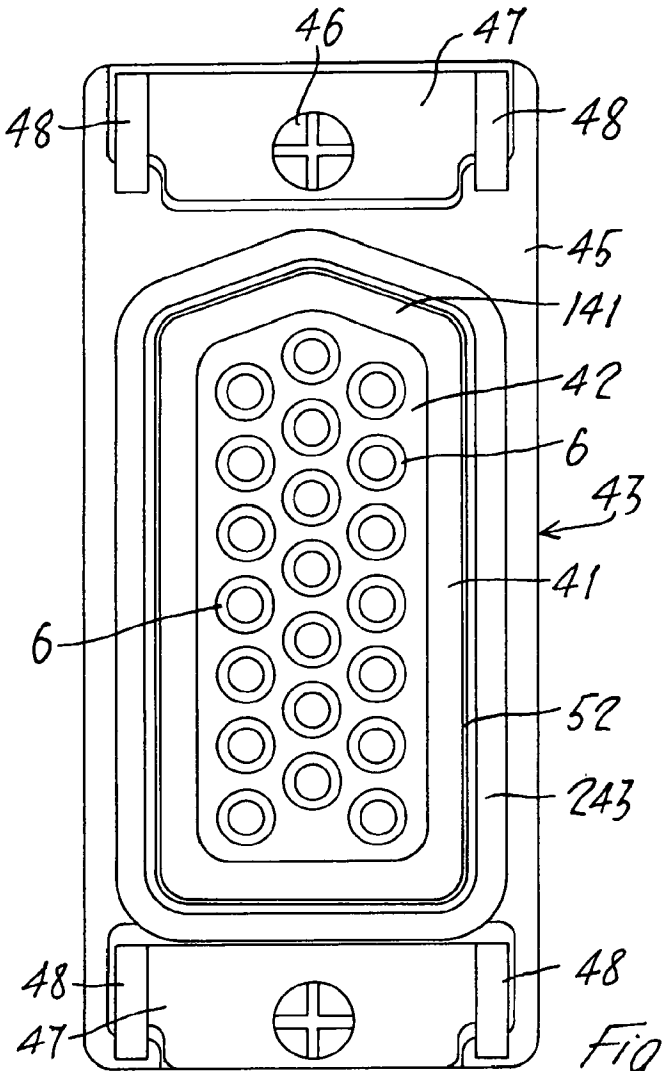
FIG. 6 shows a side view of the socket connector of the connection device according to FIG. 5.

FIG. 5 shows a second embodiment of the present connection device. In this variant the electric cable 23 is connected to the pin connector 34 so as to form substantially an L-shaped connection device. The pin connector 34 comprises a first outer body 134 with a rectangular or square cross-section inside which a second internal body 234 with a square or rectangular and internally hollow cross-section is inserted. This inner body 234 is provided externally with a flange 35 for fixing, by means of bolts 36, to the outer body 134 and internally with a bush 37 which is made of elastomer material and inside which the contacts 15 provided with associated pins 16 protruding from the through-holes 21 are embedded. Adjacent to said bush 37 inserted inside the inner body 234 of the pin connector 34, a base piece 38 made of thermoplastic material and finally a plug 39, partially shown in the figure, and similar to the plug 25 of the embodiment of the present device according to FIG. 1, are provided. An annular seal 40 is provided between the base piece 38 and the inner wall of the hollow inner body 234. This inner body 234 comprises, on the side where the pins 16 of the contacts 15 emerge, an end section 334 which able to be inserted inside an annular cavity 41, in this case with a rectangular or square shape, formed between the outer wall of a bush 42 made of thermoplastic material and the inner wall of a hollow seat 143 formed in the main body 243 of a socket connector 43. This main body 243 is inserted inside an opening 44 with a rectangular or square cross-section formed in a panel 45 and is fixed thereto by means of a flange 343 engaged by associated bolts 46. This flange 343 also has fixed thereto, by means of these bolts 46 and outside the panel 45, two plates 47 each with two hooks 48 able to receive two lugs 49 fixed to the outer body 134 of the pin connector 34. In a similar manner to the first embodiment of the present device shown above, the contact sockets 6 are embedded inside this bush 42 of the socket connector and, in the direction towards the inner side of the panel 45, a sealing base piece 50 made of elastomer material and a closing end cap 51 made of sealing material such as epoxy resin or the like is provided adjacent to this bush. A seal 52 is provided between the inner wall of the main body 243 of the socket connector 43 and the outer wall of the inner body 234 of the pin connector 34. The device shown in FIG. 5 is also provided with a keying system, shown in FIGS. 6 and 7. The annular cavity 41, with a substantially rectangular shape, of the main body 243 of the socket connector 43 comprises on one side a hollow section 141 with a particular shape, for example a V-shape as shown in FIG. 6, so as to engage with a corresponding projecting section 434 (see FIG. 7) of the end section 334 of the inner body 234 of the pin connector 34. In this way the insertion of the pin connector 34 inside the socket connector 43 may be performed in a uniquely defined manner, ensuring correct insertion of the pins 16 inside the corresponding contact sockets 6. As can be understood from the above description, when the pin connector 11 or 34 is inserted inside the socket connector 3 or 43, an effective seal is ensured, preventing the entry of atmospheric agents owing to the various bushes, base pieces, seals and plugs provided in the positions described and made preferably using the materials indicated in the description above. In the connection device shown in FIG. 1, when the pin connector 11 is introduced inside the socket connector 3, by gripping the sleeve 26, the toroidal spring 13 is already inserted inside the associated annular groove 903 and is slightly compressed by the insertion of the cylindrical end section 111 of the main body 211 of this pin connector 11, until it substantially snap-engages inside the annular groove 311 formed in the outer wall of said cylindrical end section 111. In order to extract the pin connector 11 from the socket connector 3 it is sufficient to grip the sleeve 26 and pull it towards the outside of the panel 1 so that the cylindrical end section 111 compresses again the toroidal spring 13. The use, moreover, of contacts 15, in which the axial stem 19 with the associated helical spring 20 and scored hyperboloid 29 are enclosed inside a tubular container body 18, ensures maximum continuity and efficiency of the electrical or electronic connection and prevents any misalignment in the assembly of the unit, thus resulting in a connection device which is long-lasting and highly reliable both mechanically and electrically speaking.

The invention claimed is:

1. Connection device for electrical or electronic connections, comprising a socket connector with a plurality of contact sockets and a pin connector connected to an electric cable and with a plurality of contacts provided with pins able to engage with said contact sockets following insertion of said pin connector inside said socket connector, wherein the pin connector comprises an internally hollow main body which houses, inside it, at least one first bush which is made of insulating material and inside which said contacts are inserted and from which said pins protrude, and said socket connector comprising an internally hollow main body which houses inside it a second bush which is made of insulating material and inside of which said contact sockets are inserted, said main body of the pin connector being provided with a free section able to engage sealingly inside an annular cavity formed between said second bush made of insulating material and the inner walls of the main body of said socket connector, the main body of said socket connector comprising a first cylindrical seat in which an annular groove for housing a toroidal spring is formed, said cylindrical end section of the pin connector being inserted in said first cylindrical seat, and an annular groove able to receive said toroidal spring, during the substantially snap-type engagement of the pin connector inside the socket connector, being formed on the outside of said pin connector.

2. Connection device according to claim 1, wherein said first bush of the pin connector is made of elastomer material, such as rubber or neoprene.

3. Connection device according to claim 1, wherein said second bush of the socket connector is made of thermoplastic material.

4. Connection device according to claim 1, wherein said second bush is inserted inside a first seat formed inside the main body of the socket connector and followed by an opening inside which a sealing plug made of materials such as epoxy resin is inserted.

5. Connection device according to claim 1, wherein said socket connector comprises a sealing base piece which is made of elastomer material, and is positioned between said bush and said plug in a seat formed on one side of said bush.

6. Connection device according to claim 1, wherein said socket connector comprises a mouth for insertion of the pin connector, sealing means being inserted between the inner wall of the mouth of said socket connector and the outer wall of the main body of the pin connector.

7. Connection device according to claim 1, wherein the main body of said pin connector comprises a gripping sleeve which is made of plastic and fitted around the outer wall of said main body and said closing plug.

8. Connection device according to claim 1, wherein said pin connector comprises an outer main body and an inner main body which is inserted inside said outer main body and fixed thereto by means of suitable means, said outer main body being provided with a series of lugs for fixing to associated hooks connected to a flange formed in the main body of the socket connector.

9. Connection device according to claim 1, wherein each of said pins of said contacts inserted in said first bush comprise resilient-tensioning means which act in the axial direction on said pin provided with a coaxial stem which extends at the end opposite to that intended for connection, said stem being inserted inside a contact means in the form of a scored hyperboloid enclosed, together with said resilient-tensioning means, inside a tubular container body in which means are provided for locating said resilient-tensioning means, and through-holes for allowing said pins to pass out being formed on one side of said first bush.

10. Connection device according to claim 9, wherein an end lug is provided between said pin and said coaxial stem of each of said contacts, said end lug being adjacent to the through-hole for allowing the pin formed in said first bush to pass out, a seal being housed between the bottom of said tubular container body and said end lug.

11. Connection device according to claim 1, wherein said pin connector is inserted in said socket connector by means of suitable keying means which allow a single position for insertion of said pin connector in said socket connector for correct formation of the contact between said pins and said sockets.

12. Connection device according to claim 11, wherein the main body of the socket connector has, formed inside it, a cylindrical seat provided with longitudinal grooves which are suitably positioned and able to engage with corresponding ribs formed on the outside of the cylindrical end section of the main body of the pin connector.

13. Connection device according to claim 11, wherein said annular cavity of said socket connector has a substantially rectangular or square cross-section and comprises on at least one side a hollow section with a particular shape, so as to engage with a corresponding projecting section of the end section of the main body of the pin connector.

14. Connection device according to claim 1, wherein said pin connector comprises an additional bush or base piece which is made of thermoplastic material, and which is situated adjacent to said first bush and is passed through by suitable contact wires of said electric cable.

15. Connection device according to claim 14, wherein said pin connector comprises a mouth for receiving a closing plug which is made of plastic and inside which said electric cable is inserted, said plug being adjacent to said additional bush or base piece.

16. Connection device for electrical or electronic connections, comprising a socket connector with a plurality of contact sockets and a pin connector connected to an electric cable and with a plurality of contacts provided with pins able to engage with said contact sockets following insertion of said pin connector inside said socket connector, wherein the pin connector comprises an internally hollow main body which houses, inside it, at least one first bush which is made of insulating material and inside which said contacts are inserted and from which said pins protrude, and said socket connector comprising an internally hollow main body which houses inside it a second bush which is made of insulating material and inside of which said contact sockets are inserted, said main body of the pin connector being provided with a free section able to engage sealingly inside an annular cavity formed between said second bush made of insulating material and the inner walls of the main body of said socket connector, each of said pins of said contacts inserted in said first bush comprise resilient-tensioning means which act in the axial direction on said pin provided with a coaxial stem which extends at the end opposite to that intended for connection, said stem being inserted inside a contact means in the form of a scored hyperboloid enclosed, together with said resilient-tensioning means, inside a tubular container body in which means are provided for locating said resilient-tensioning means, and through-holes for allowing said pins to pass out being formed on one side of said first bush.

17. Connection device according to claim 16, wherein an end lug is provided between said pin and said coaxial stem of each of said contacts, said end lug being adjacent to the through-hole for allowing the pin formed in said first bush to pass out, a seal being housed between the bottom of said tubular container body and said end lug.

18. Connection device according to claim 16, wherein said pin connector is inserted in said socket connector by means of suitable keying means which allow a single position for insertion of said pin connector in said socket connector for correct formation of the contact between said pins and said sockets.

19. Connection device according to claim 16, wherein said first bush of the pin connector is made of elastomer material, such as rubber or neoprene.

20. Connection device according to claim 16, wherein said second bush of the socket connector is made of thermoplastic material.

* * * * *